US007988263B2

(12) United States Patent
Seto et al.

(10) Patent No.: US 7,988,263 B2
(45) Date of Patent: Aug. 2, 2011

(54) LIQUID DROPLET EJECTION HEAD, LIQUID DROPLET EJECTION DEVICE, AND IMAGE FORMING APPARATUS

(75) Inventors: Shinji Seto, Kanagawa (JP); Hiroyuki Usami, Ibaraki (JP); Michiaki Murata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 901 days.

(21) Appl. No.: 11/951,521

(22) Filed: Dec. 6, 2007

(65) Prior Publication Data

US 2008/0218556 A1 Sep. 11, 2008

(30) Foreign Application Priority Data

Mar. 8, 2007 (JP) ..... 2007-058107

(51) Int. Cl.
*B41J 2/045* (2006.01)

(52) U.S. Cl. ..... 347/71

(58) Field of Classification Search ..... 347/70–72
See application file for complete search history.

(56) References Cited

U.S. PATENT DOCUMENTS 5,245,244 A * 9/1993 Takahashi et al. ..... 310/328

FOREIGN PATENT DOCUMENTS

| | | |
|---|---|---|
| JP | 5-050599 | 3/1993 |
| JP | 3522163 | 5/2000 |
| JP | 2006-289965 | 10/2006 |
| JP | 2006289965 | * 10/2006 |

* cited by examiner

*Primary Examiner* — Jerry T Rahll
(74) *Attorney, Agent, or Firm* — Fildes & Outland, P.C.

(57) ABSTRACT

A liquid droplet ejection head having: a vibrating plate at which is formed a piezoelectric element which deforms when voltage is applied; a wiring board disposed above the piezoelectric element, an electric wire for deforming the piezoelectric element being disposed at the wiring board; a liquid storage chamber provided at a side opposite to the piezoelectric element, with the wiring board sandwiched therebetween; a pressure chamber provided at a side opposite to the wiring board, with the vibrating plate sandwiched therebetween; an ejection opening that ejects liquid droplets from the pressure chamber; a liquid supply opening that supplies liquid within the liquid storage chamber to the pressure chamber; and an electrical connection portion that passes through the wiring board and electrically connects the piezoelectric element and the electric wire through the liquid supply opening, is provided.

11 Claims, 11 Drawing Sheets

LIQUID DROPLET EJECTION HEAD, LIQUID DROPLET EJECTION DEVICE, AND IMAGE FORMING APPARATUS

CROSS-REFERENCE TO RELATED APPLICATION

This application is based on and claims priority under 35 USC 119 from Japanese Patent Application No. 2007-058107 filed on Mar. 8, 2007.

BACKGROUND

1. Technical Field

The present invention relates to a liquid droplet ejection head, a liquid droplet ejection device, and an image forming apparatus.

2. Related Art

There is known an inkjet recording device (liquid droplet ejection device) which records images (including characters) and the like onto recording media such as recording sheets or the like by selectively ejecting ink droplets from plural nozzles of an inkjet recording head which is an example of a liquid droplet ejection head. Due to the inkjet recording head of such an inkjet recording device displacing vibrating plates which structure pressure chambers, ink which is filled within the pressure chambers is ejected from the nozzles. Piezoelectric elements for displacing the vibrating plates are formed on the vibrating plates.

SUMMARY

According to an aspect of the invention, there is provided a liquid droplet ejection head having: a vibrating plate at which is formed a piezoelectric element which deforms when voltage is applied; a wiring board disposed above the piezoelectric element, an electric wire for deforming the piezoelectric element being disposed at the wiring board; a liquid storage chamber provided at a side opposite to the piezoelectric element, with the wiring board sandwiched therebetween; a pressure chamber provided at a side opposite to that ejects liquid droplets from the pressure chamber; a liquid supply opening that supplies liquid within the liquid storage chamber to the pressure chamber; and an electrical connection portion that passes through the wiring board and electrically connects the piezoelectric element and the electric wire through the liquid supply opening.

BRIEF DESCRIPTION OF THE DRAWINGS

Exemplary embodiments of the present invention will be described in detail based on the following figures, wherein.

DETAILED DESCRIPTION

Figure 1:
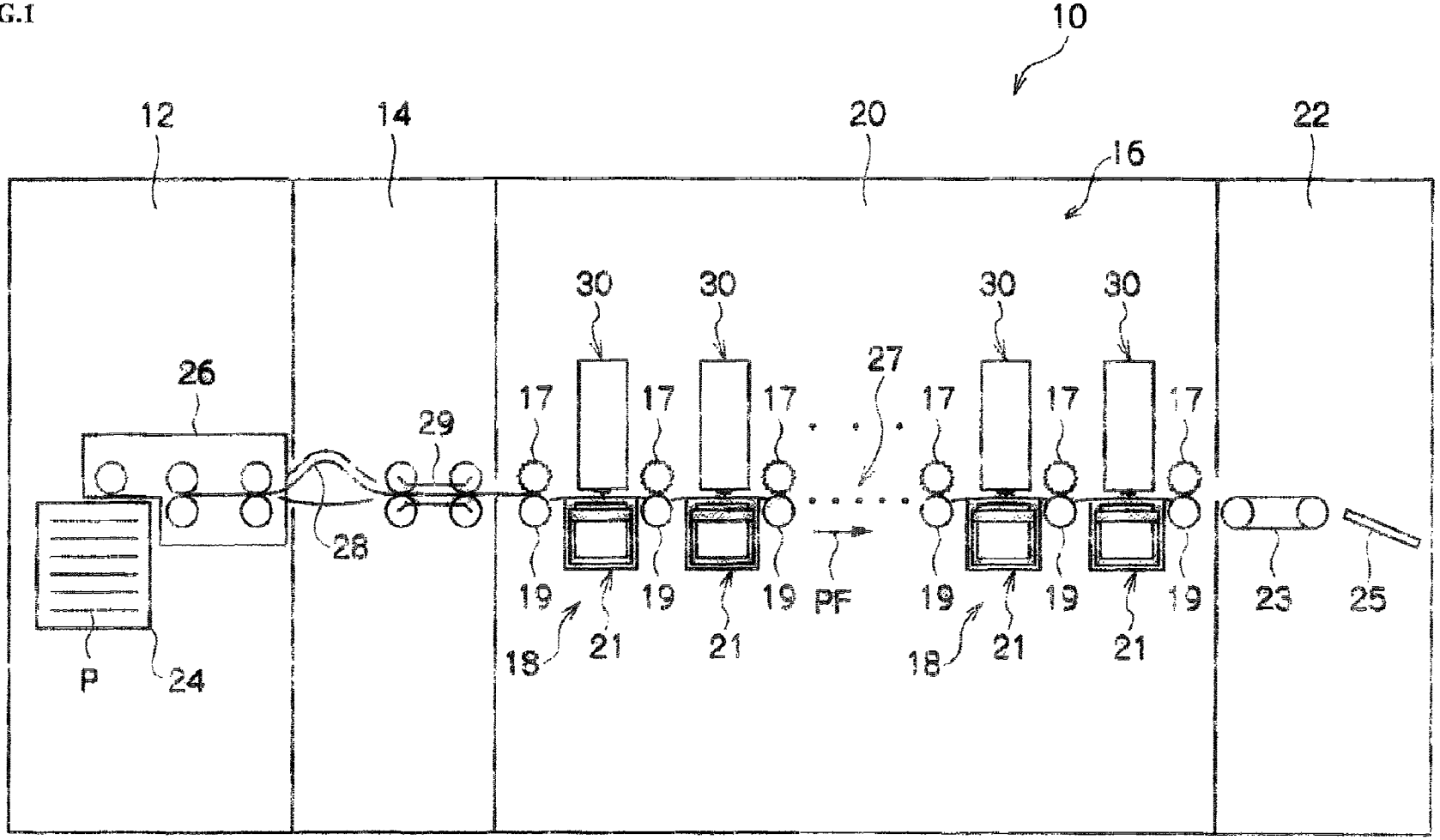
FIG. 1 is schematic front view showing an inkjet recording device relating to the exemplary embodiments of the present invention.

Hereinafter, preferred exemplary embodiments of the present invention will be described in detail on the basis of the examples illustrated in the drawings.

First, an inkjet recording device 10 equipped with liquid droplet ejection heads will be described as an example. Accordingly, description is given with the liquid being an ink 110, and the liquid droplet ejection head being an inkjet recording head 32. Further, description is given with the recording medium being a recording sheet P.

As shown in FIG. 1, the inkjet recording device 10 is basically structure from a sheet supplying portion 12 which feeds-out the recoding sheet P; a registration adjusting portion 14 controlling the posture of the recording sheet P; a recording portion 20 having a recording head portion 16 which ejects ink droplets and forms an image on the recording sheet P, and a maintenance portion 18 which carries out maintenance of the recording head portion 16; and a discharging portion 22 discharging the recording sheet P on which an image has been formed at the recording portion 20.

The sheet supplying portion 12 is structured from a stocker 24 in which the recording sheets P are layered and stocked, and a conveying device 26 which removes the recording sheet P one-by-one from the stocker 24 and conveys it to the registration adjusting portion 14. The registration adjusting portion 14 has a loop forming portion 28 and a guide member 29 which controls the posture of the recording sheet P. Due to the recording sheet P passing through this portion, the skew is corrected by utilizing the strain thereof, and the conveying timing is controlled, and the recording sheet P is supplied to the recording portion 20. Further, via a sheet discharging belt 23, the discharging portion 22 accommodates the recording sheet P, on which an image has been formed at the recording portion 20, at a tray 25.

A sheet conveying path 27 along which the recording sheet P is conveyed is structured between the recording head portion 16 an the maintenance portion 18 (the sheet conveying direction is shown by arrow PF). The sheet conveying path 27 has star wheels 17 and conveying rollers 19, and continuously (without stoppage) conveys the recording sheet P while nipping the recording sheet P between the star wheels 17 and the conveying rollers 19. Ink droplets are ejected from the recording head portion 16 onto the recording sheet P, and an image is formed on the recording sheet P.

The maintenance portion 18 has maintenance devices 21 which are disposed so as to oppose inkjet recording units 30, and carries out processings such as capping, wiping, preliminary ejecting, suctioning, and the like on the inkjet recording heads 32.

Figure 2:
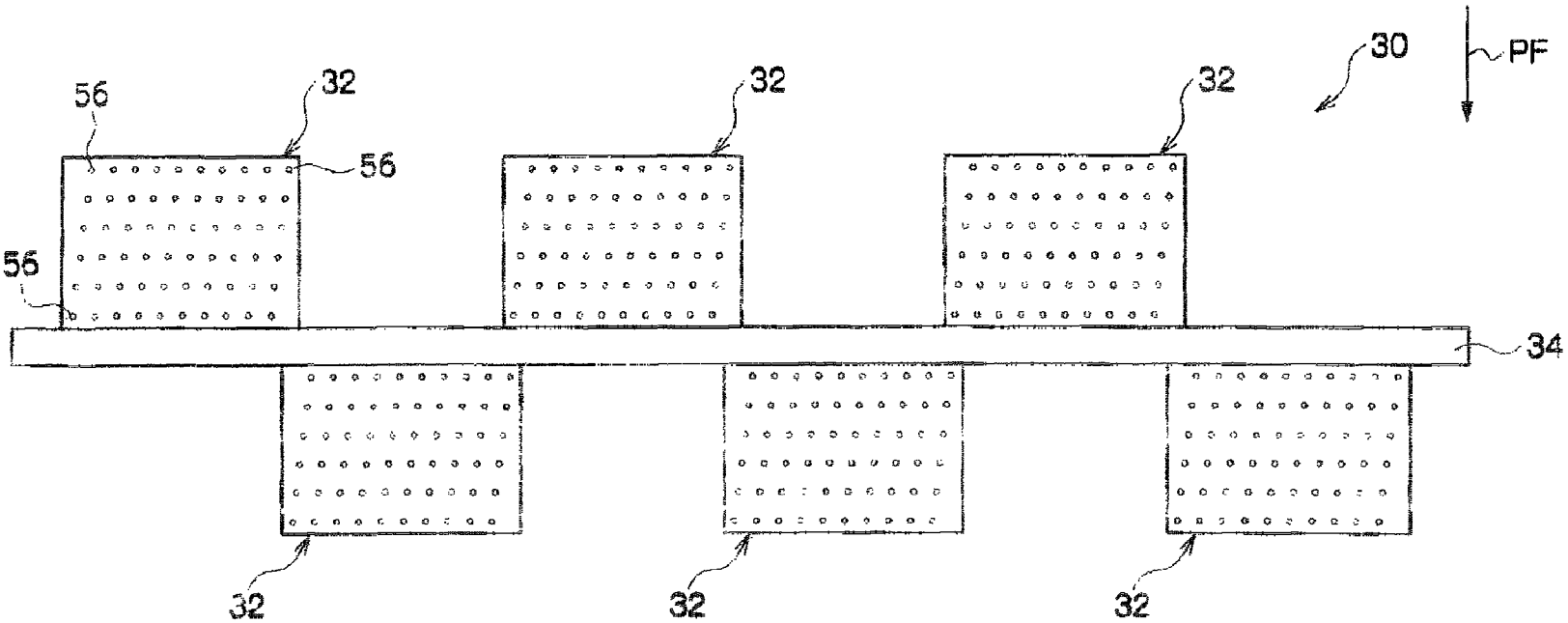
FIG. 2 is an explanatory drawings showing an array of inkjet recording heads relating to the exemplary embodiments of the present invention.

As shown in FIG. 2, each inkjet recording unit 30 has a supporting member 34 which is disposed in a direction orthogonal to the sheet conveying direction shown by arrow PF. A plurality of the inkjet recording heads 32 are mounted to the supporting member 34. Plural nozzles (ejection opening) 56 are formed in the form of matrix at the inkjet recording head 32, such that the nozzles 56 are lined-up at a uniform pitch across the overall inkjet recording unit 30 in the width direction of the recording sheet P.

An image is recorded on the recording sheet P by ink droplets being ejected from the nozzles 56 onto the recording sheet P which is conveyed continuously along the sheet conveying path 27. Note that at least four of the inkjet recording units 30 are disposed in correspondence with the respective colors of yellow (Y), magenta (M), cyan (C), an black (K) in order to record a so-called full-color image for example.

Figure 3:
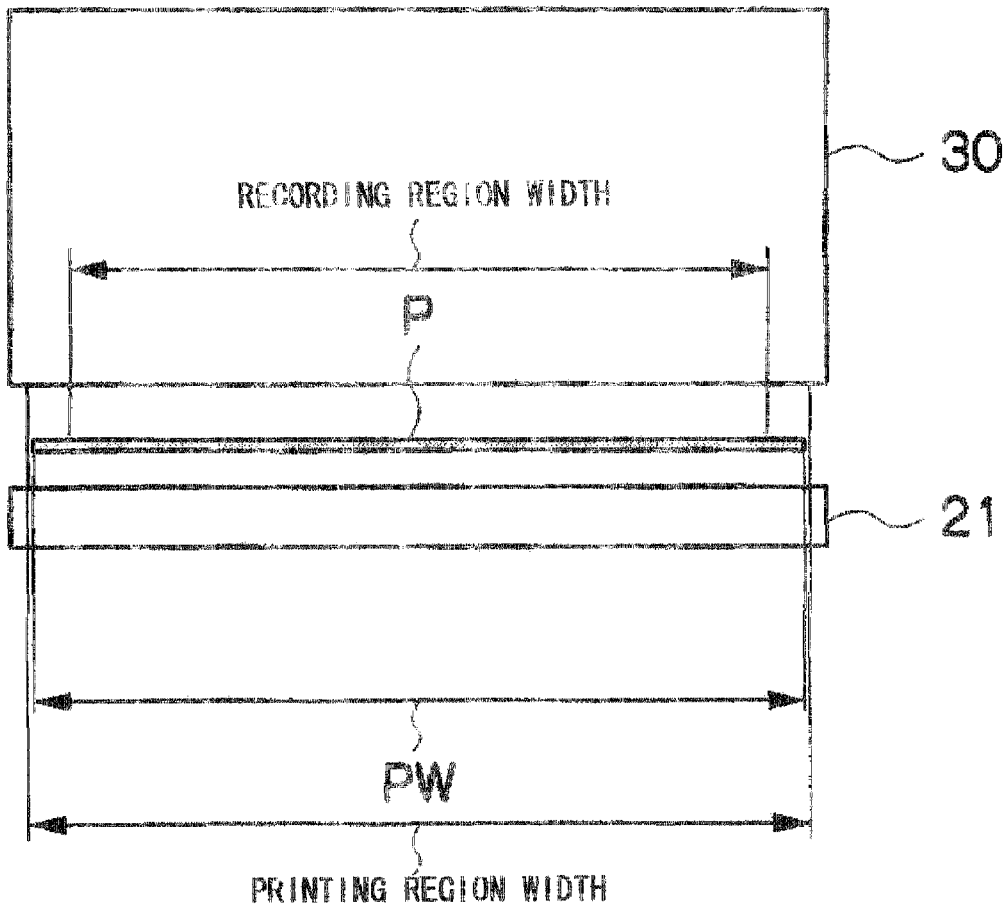
FIG. 3 is an explanatory drawing showing the relationship between the width of a recording medium and the width of a printing region of the inkjet recording head relating to the exemplary embodiments of the present invention.

As shown in FIG. 3, the width of the printing region by the nozzles 56 of each inkjet recording unit 30 is longer than a maximum sheet width PW of the recording sheet P for which image recording at the inkjet recording device 10 is supposed, such that image recording over the entire width of the recording sheet P is possible without moving the inkjet recording unit 30 in the width direction of the sheet. Namely, the inkjet recording unit 30 is a Full-Width Array (FWA) at which single-pass printing is possible.

Here, the basic printing region width is the maximum width among recording regions from which margins, at which printing is not carried out, are subtracted from the both ends of the recording sheet P, and generally, is larger than the maximum sheet width PW which is the object of printing. This is because there is the concern that the recording sheet P will be conveyed while inclined at a predetermined angle with respect to the conveying direction (i.e., while skewed), and because the demand for borderless printing is high.

Figure 4:
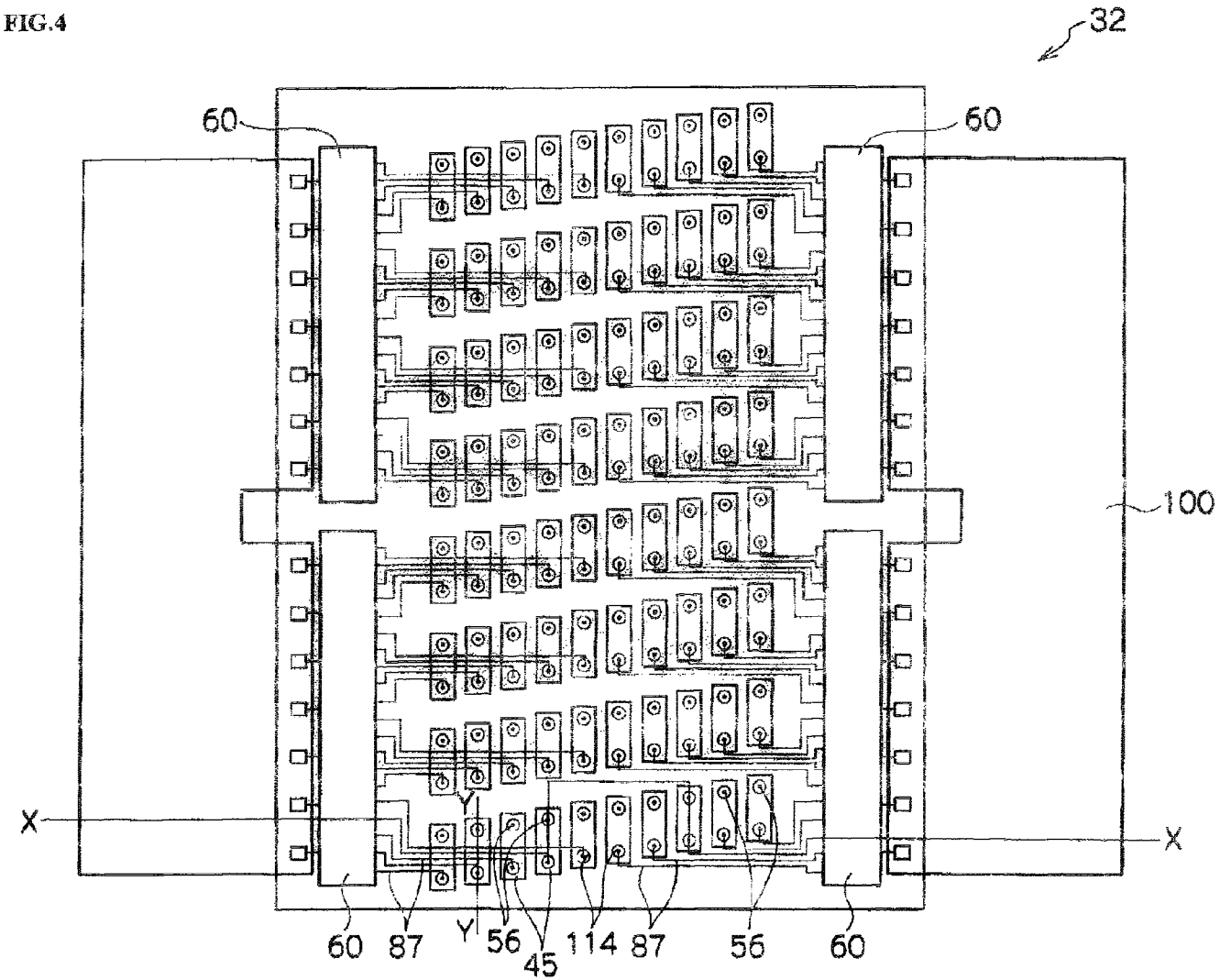
FIG. 4 is a schematic plan view of the inkjet recording head relating to the exemplary embodiments of the present invention.
Figure 5:
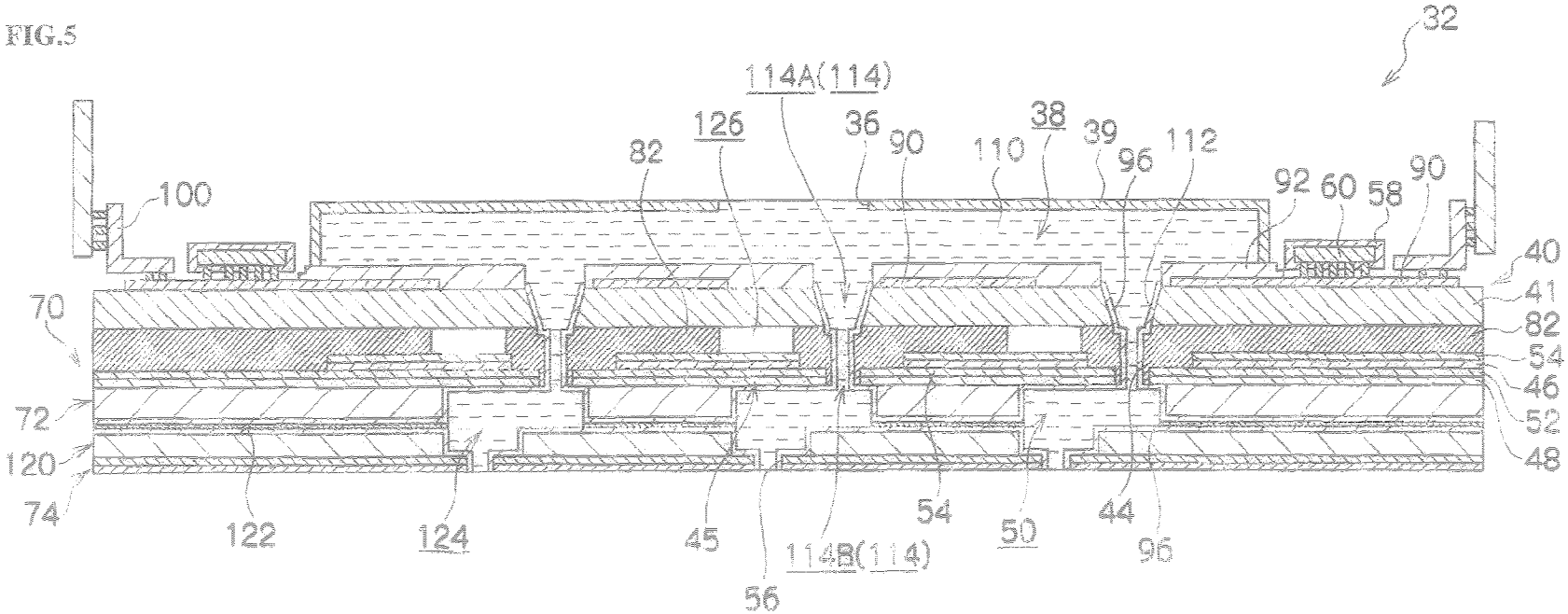
FIG. 5 is a cross-sectional view along line X-X of FIG. 4.
Figure 7A:
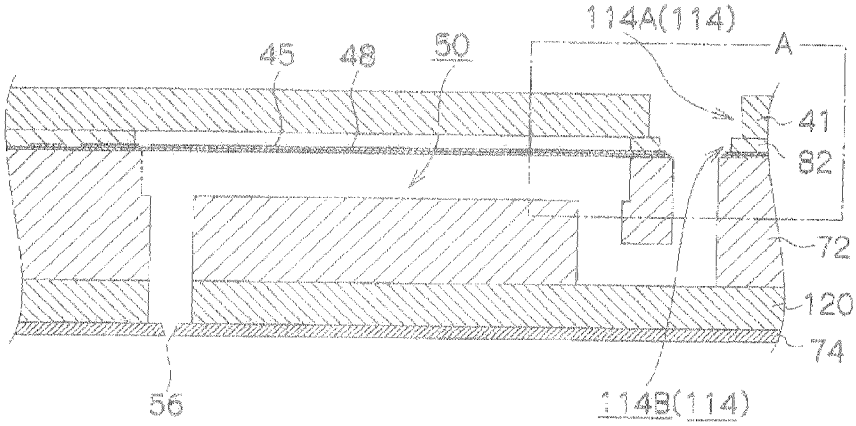
FIG. 7A is a cross-sectional view along line Y-Y of FIG. 4.
Figure 7B:
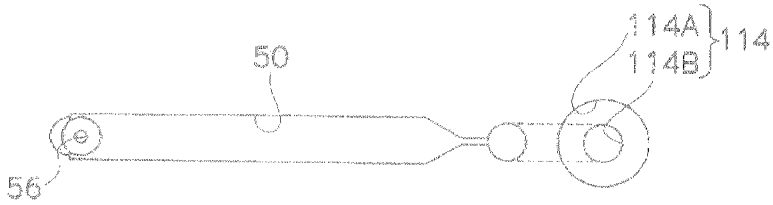
FIG. 7B is a schematic plan view of FIG. 7A.
Figure 8:
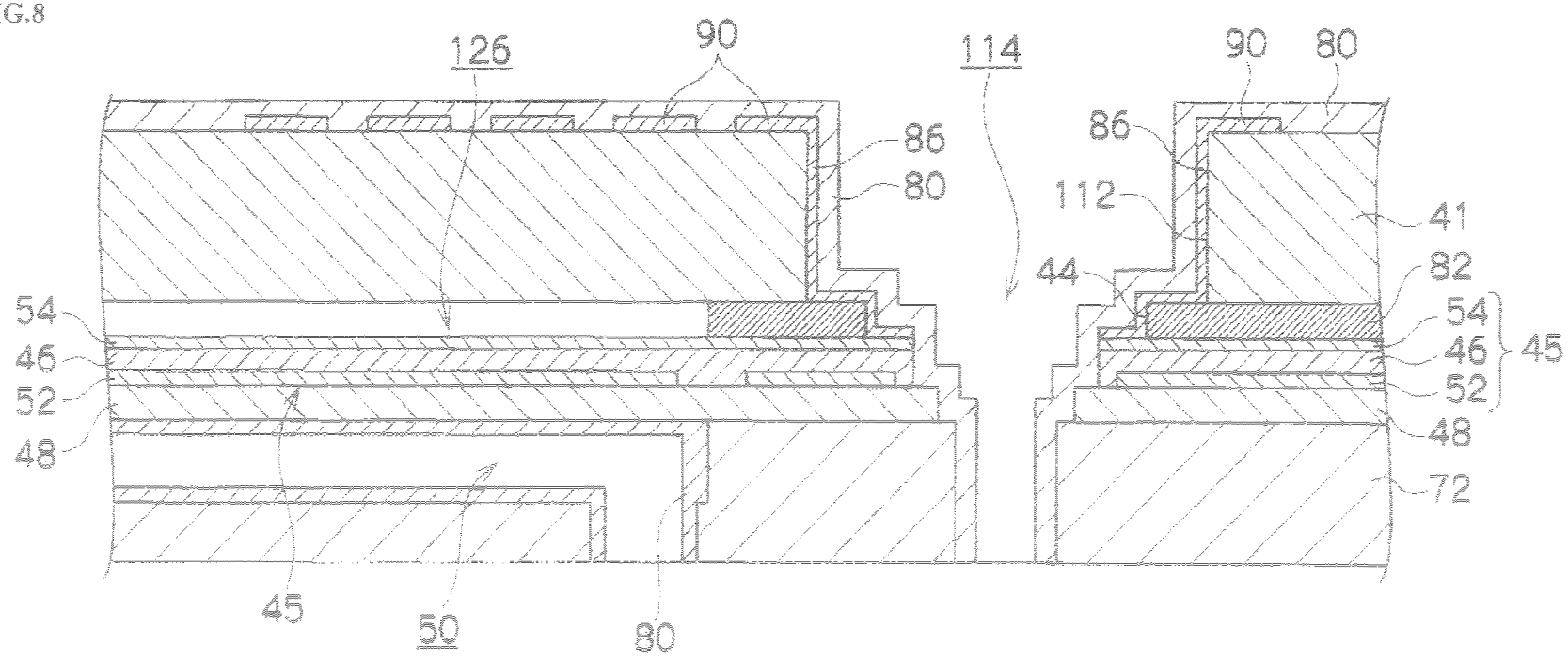
FIG. 8 is an enlarged view of region A of FIG. 7A, and is a cross-sectional view of an inkjet recording head relating to a first exemplary embodiment.

Next, the inkjet recording head 32 in the inkjet recording device 10 of the above-described structure will be described in detail. Note that FIG. 4 is a schematic plan view showing the overall structure of the inkjet recording head 32, and FIG. 5 is a cross-sectional view along line X-X of FIG. 4. Further, FIG. 7A is a schematic cross-sectional view along line Y-Y of FIG. 4, and FIG. 7B is a plan view of FIG. 7A. FIG. 8 is an enlarged view of region A shown in FIG. 7A.

FIRST EXEMPLARY EMBODIMENT

As shown in FIG. 4 and FIG. 5, a top plate member 40 is disposed at the inkjet recording head 32. In the present exemplary embodiment, a top plate (wiring board) 41, which is made of glass and structures the top plate member 40, is plate-shaped and has wires, and is the top plate of the overall inkjet recording head 32.

A pooling chamber member 39, which is formed of an ink-resistant material, is adhered to the top plate member 40. An ink pooling chamber (liquid storage chamber) 38 with a predetermined shape and volume is formed between the pooling chamber member 39 and the top plate 41. An ink supply port 36 is stored in the ink pooling chamber 38.

Driving ICs 60, and metal wires 90 for energizing the driving ICs 60, are provided at the top plate member 40. The metal wires 90 are covered and protected by a resin protective film 92 such that erosion of the metal wires 90 by the ink 110 is prevented. Note that flexible printed circuits (FPCs) 100 are also connected to the metal wires 90.

Figure 6:
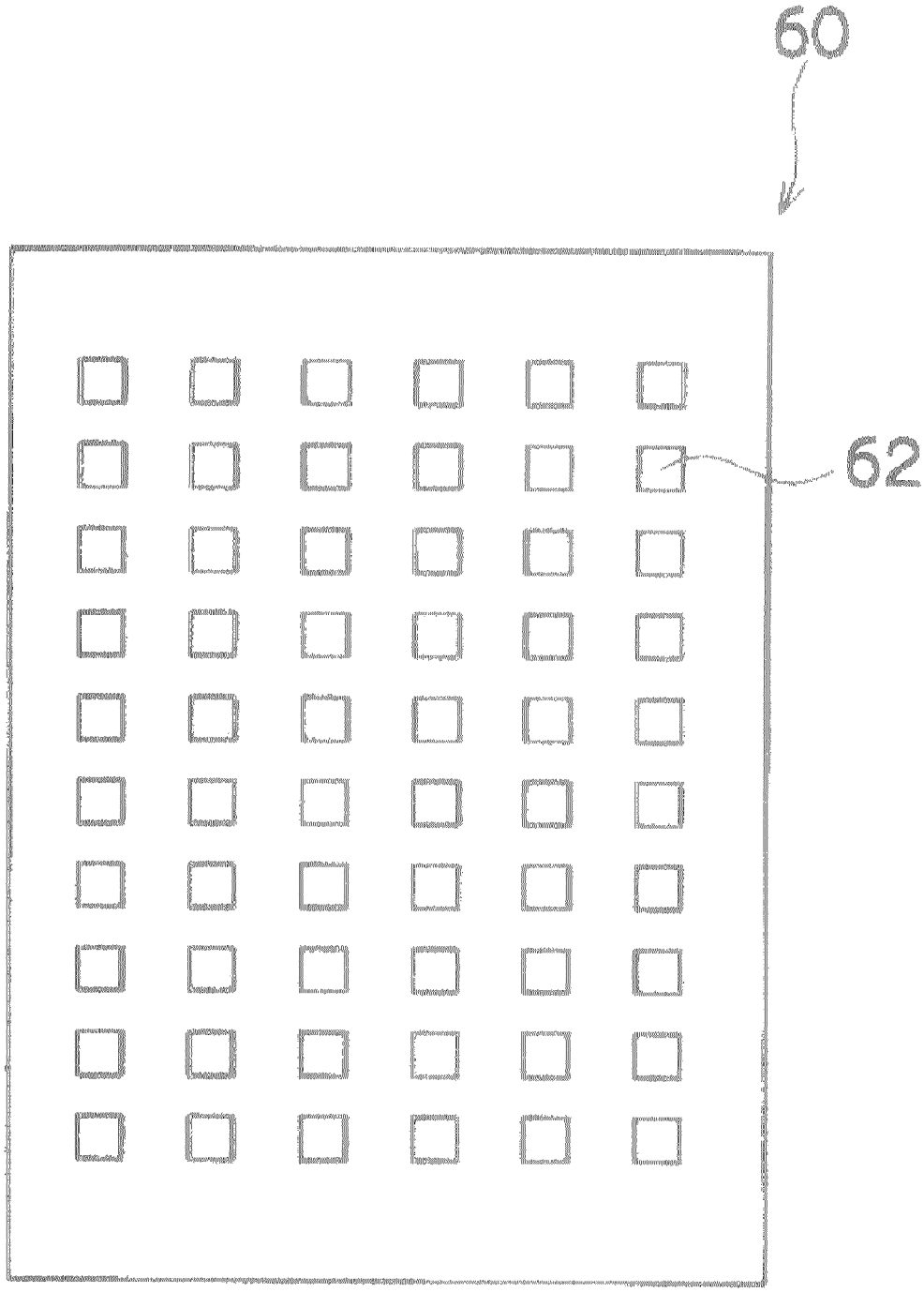
FIG. 6 is a schematic plan view showing bumps of a driving IC of the inkjet recording head relating to the exemplary embodiments of the present invention.

On the other hand, as shown in FIG. 6, plural bumps 62 project out by predetermined heights and in the form of a matrix at the bottom surface of the driving IC 60, and are flip-chip mounted to the metal wire 90 on the top plate 41 at the outer side of the pooling chamber member 39. Note that the periphery of the driving IC 60 is sealed by a resin material 58.

Through-holes 112 for ink supply, which correspond one-to-one to pressure chambers 50 which will be described later, pass through the top plate 41, and the interiors thereof are first ink supply paths (liquid supply opening) 114A.

The pressure chamber 50, in which is filled the ink 110 which is supplied from the ink pooling chamber 38, are formed in a silicon substrate 72 which serves as a flow path substrate. A communicating path substrate 120, which is formed of SUS, is joined via an adhesive 122 to the bottom portion of the silicon substrate 72.

Communicating paths 124 which are connected to the pressure chambers 50 are formed in the communicating path substrate 120. The communicating paths 124 are spaces which are narrower than the pressure chambers 50. Further, a nozzle plate 74, in which are formed the nozzles 56 which are connected with the communicating paths 124, is adhered to the bottom surface of the communicating path substrate 120.

A piezoelectric element substrate 70 is formed on the top surface of the silicon substrate 72. The piezoelectric element substrate 70 has vibrating plates 48. The vibrating plates 48 structure one surfaces of the pressure chambers 50. The vibrating plate 48 is an SiOx film which is formed by Chemical Vapor Deposition (CVD), and has elasticity at least in the vertical direction. When voltage is applied to a piezoelectric element 45 which will be described later, the vibrating plate 48 flexurally deforms (displaces) in the vertical direction. Note that the vibrating plate 48 may be a metal material such as Cr or the like. by generating a pressure wave by increasing and decreasing the volume of the pressure chamber 50 due to vibration of the vibrating plate 48, ink droplets are ejected from the nozzle 56 via the pressure chamber 50 and the communicating path 124.

The piezoelectric element 45 is provided on the top surface of the vibrating plate 48 for each of the pressure chamber 50. The piezoelectric element 45 is structured by an upper electrode 54 and a lower electrode 52 between which is sandwiched a piezoelectric side of the piezoelectric element 45. Further, the lower electrode 52 is ground potential.

Spaces 126 (air layers) are provided between the top plate 41 and the piezoelectric elements 45 (more exactly, the upper electrodes 54), so as to not affect the driving of the piezoelectric elements 45 and the vibrating of the vibrating plates 48.

A partitioning resin layer 82 is layered on the piezoelectric elements 45. The partitioning resin layer 82 demarcates the space between the piezoelectric element substrate 70 and the top plate member 40. Through-holes 44 for ink supply, which connect the through-holes 122 for ink supply of the top plate 41 and the pressure chambers 50 of the silicon substrate 72, pass through the partitioning resin layer 82, and the interiors thereof are second ink supply paths (liquid supply opening) 114B. Here, the second ink supply paths 114B are through-holes which connect the through-holes 112 for ink supply and the pressure chambers 50, and also include through holes which are formed in the piezoelectric elements 45 and the vibrating plates 48 (see FIG. 8).

The second ink supply path 114B has a cross-sectional area which is smaller than the cross-sectional area of the first ink supply path 114A, such that the flow path resistance in an entire ink supply path 114 is adjusted to become a predetermined value. Namely, the cross-sectional area of the first ink supply path 114A is made to be sufficiently larger than the cross-sectional area of the second ink supply path 114B, and is of an extent that the flow path resistance therein can substantially be ignored as compared with the flow path resistance in the second in supply path 114B. Accordingly, the flow path resistance of the ink supply path 114 from the ink pooling chamber 38 to the pressure chamber 50 is defined in the second ink supply path 114B.

As shown in FIG. 8, connecting wires (electrical connection portions) 86 are formed at portions of the inner walls of the through-holes 112 for ink supply and the through-holes 44 for ink supply. At the through-holes 44 for ink supply, portions of the upper electrodes 54 project-out from the inner edge portions of the partitioning resin layer 82. One end sides of the connecting wires 86 are connected to the project-out portions of the upper electrodes 54, and the other end sides of the connecting wires 86 are connected to the metal wires 90. In this way, the upper electrodes 54 and the driving ICs 60 are connected.

At least the surfaces which the ink 110 contacts of the through-holes 112, 44 for ink supply (the piezoelectric bodies 45, the vibrating plates 48), the connecting wires 86, the pressure chamber 50, an d the like are covered and protected by low water permeable insulating films (SiOx films) 80 are deposited under the condition that the moisture permeability decrease, the low water permeable insulting films 80 can, in the case of the piezoelectric elements 45, prevent poor reliability due to moisture penetrating into the piezoelectric elements 45 (a deterioration in the piezoelectric characteristic caused by the oxygen within the PZT film being reduced). Further, at the connecting wires 86 and the like, the low water permeable insulating films (SiOx films) 80 prevent corrosion due to the ink. Here, the SiOx films 80 are used as the protective films, but other than that, SiC or SiCN may be used.

Operation at the inkjet recording device 10, which is equipped with the inkjet recording heads 32, will be described next.

First, when an electrical signal instructing printing is sent to the inkjet recording device 10 shown in FIG. 1, one of the recording sheets P is picked-up from the stocker 24, and is conveyed by the conveying device 26.

On the other hand, at the inkjet recording unit 30 shown in FIG. 5, the ink 110 has already been poured-in (filled-in) in the ink pooling chamber 38 of the inkjet recording head 32 from the ink tank via the ink supply port. The ink 110 which is filled in the ink pooling chamber 38 is supplied to (filled into) the pressure chambers 50 via the ink supply paths 114. At this time, a meniscus, in which the surface of the ink 110 is slightly concave toward the pressure chamber 50 side, is formed at the distal end (the ejection opening) of the nozzle 56.

Then, while the recording sheet P is being conveyed, due to ink droplets being selectively ejected from the plural nozzles 56, a portion of the image based on the image data is recorded on the recording sheet P. Namely, voltages are applied to predetermined piezoelectric elements 45 at predetermined timings by the driving ICs 60, the vibrating plates 48 are flexurally deformed in the vertical direction (are out-of-plane vibrated. pressure is applied to the ink 110 within the pressure chambers 50, and the ink 110 is ejected as ink droplets from predetermined nozzles 56.

When the image based on the image data has been completely recorded on the recording sheet P in this way, the recording sheet P is discharged-out to the tray 25 by the sheet discharging belt 23. In this way, the printing processing (image recording) onto the recording sheet P is completed.

A shown in FIG. 5, flow paths for supplying the ink within the ink pooling chamber 38 to the pressure chambers 50 must be formed in the top plate 41 and the partitioning resin layer 82 (including the vibrating plates 48 and the like) which are disposed between the ink pooling chamber 38 and the pressure chambers 50. Further, through-holes for electrical wiring must be formed int h top plate 41 and the partitioning resin layer 82 in order to electrically connect the driving ICs 60, which are disposed on the top surface of the top plate 41, and the piezoelectric elements 45 which are positioned at the lower portion of the partitioning resin layer 82.

However, in the present exemplary embodiment, as shown in FIG. 8, the connecting wires 86 are disposed at portions of the inner walls of the through-holes 112 for ink supply and the through-holes 44 for ink supply (the ink supply paths 114), which are the flow paths for supplying the ink within the ink pooling chamber 38 to the pressure chambers 50. By connecting the connecting wires 86 to the upper electrodes 54 and the metal wires 90 which are connected to the driving ICs 60 (see FIG. 5), the aforementioned through-holes for electrical wiring become unnecessary.

Accordingly, as compared with a case in which the through-holes for electrical wiring and the ink supply paths are formed at separate holes, fewer holes are formed in the top plate 41. Therefore, the electrical wiring region can be broadened, and, as a result, the inkjet recording head 32 can be made to be compact.

Note that, here, the connecting wires 86 are formed at portions of the inner walls of the through-holes 112 for ink supply and the through-holes 44 for ink supply (the ink supply paths 114), and the metal wires 90 and the upper electrodes 54 are connected by the connecting wires 86. However, because it suffices to be able to electrically connect the metal wires 90 and the upper electrodes 54, the structure which is employed is not limited to this.

SECOND EXEMPLARY EMBODIMENT

The inkjet recording head 32 of a second exemplary embodiment will be described next. Note that, in the following description, structural elements, members and the like which are the same as those of the inkjet recording head 32 of the first exemplary embodiment are denoted by the same reference numerals, and detailed description thereof (including description of the operation thereof) is omitted.

Figure 9:
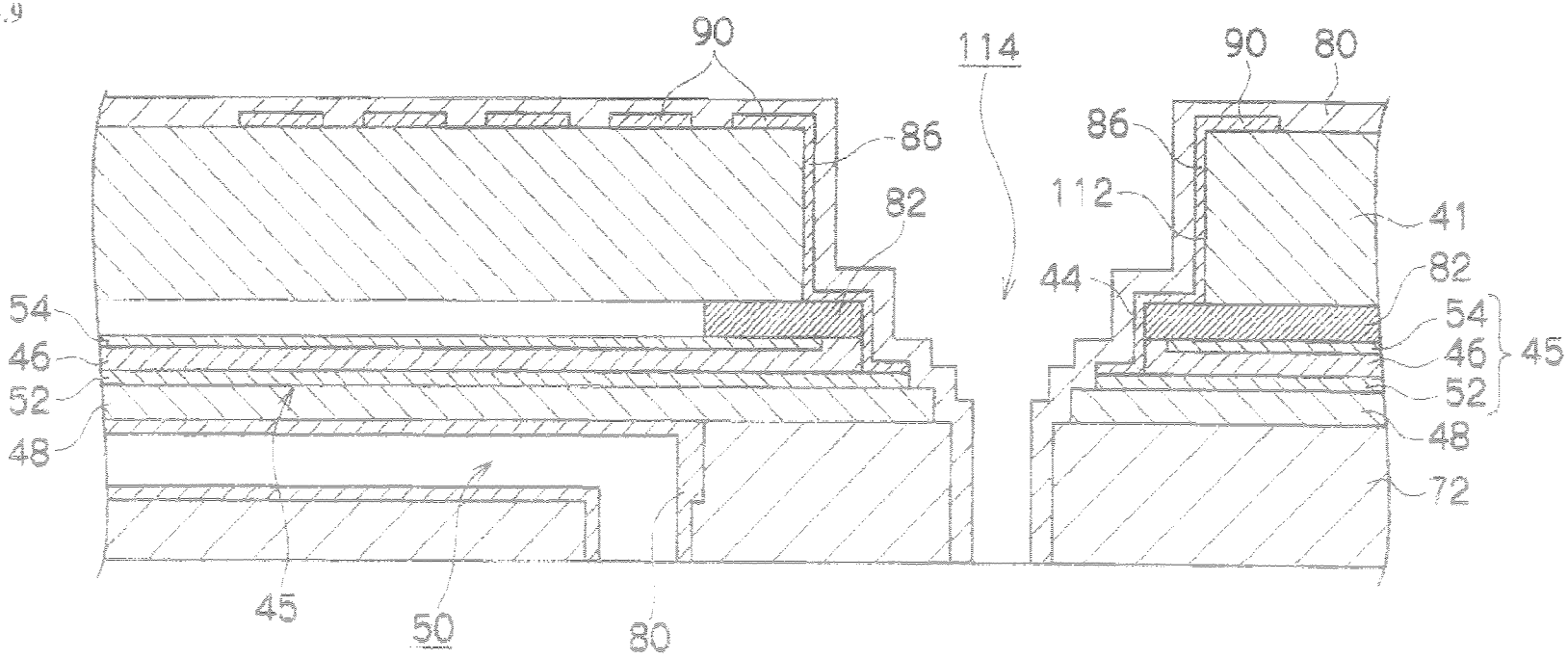
FIG. 9 is an enlarged view of region A of FIG. 7A, and is a cross-sectional view of an inkjet recording head relating to a second exemplary embodiment.

In the present exemplary embodiment, the upper electrode 54 side is made to be a common electrode and ground potential, and the lower electrode 52 side is made to be individual electrodes. Specifically, as shown in FIG. 9, the upper electrode 54 is at the outer side of the inner edge portion of the piezoelectric body 46, and a portion of the lower electrode 52 projects-out from the inner edge portions of the partitioning resin layer 82 and the piezoelectric body 46. Further, the connecting wire 86 which is connected to the metal wire 90 is connected to the projecting-out portion of the lower electrode 92.

THIRD EXEMPLARY EMBODIMENT

The inkjet recording head 32 of a third exemplary embodiment will be described next. Next that, in the following description, structural elements, members and the like which are the same as those of the inkjet recording head 32 of the second exemplary embodiment are denoted by the same reference numerals, and detailed description thereof (including description of the operation thereof) is omitted.

Figure 10:
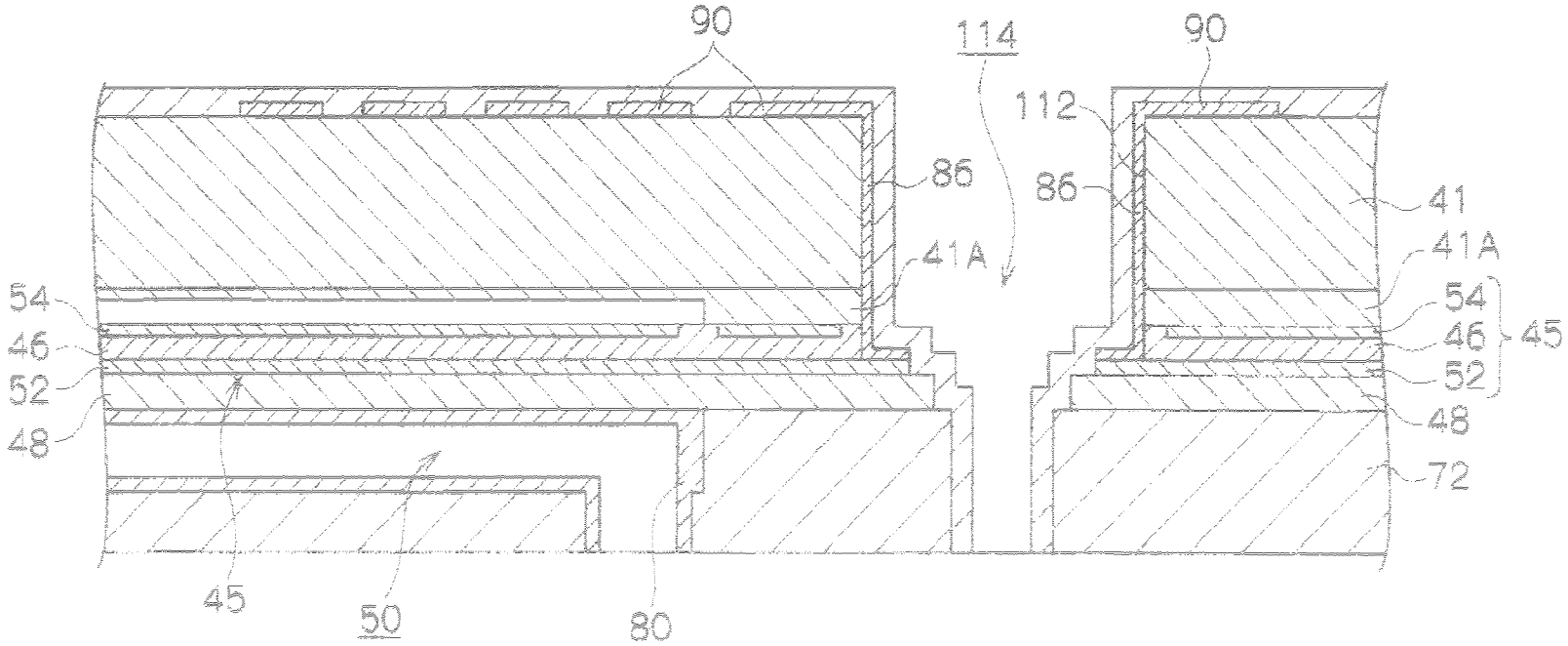
FIG. 10 is an enlarged view of region A of FIG. 7A, and is a cross-sectional view of an inkjet recording head relating to a third exemplary embodiment.

In the present exemplary embodiment, as shown in FIG. 10, projecting portions 41A are formed convexly at positions of the bottom surface side of the top plate 41, which positions correspond to the peripheral walls of the pressure chambers 50. Namely, this is a structure which does not use the partitioning resin layer 82 which is provided int he second exemplary embodiment.

Accordingly, the connecting wires 86 are formed along the surfaces of the top plate 41 (more exactly, including the piezoelectric bodies 46). In a case in which the connecting wires 86 are disposed at the surfaces of the top plate 41 and the partitioning resin layer 82 as shown in FIG. 9, depending on the material of the resin film which is used as the partitioning resin layer 82, there is the concern that the connecting wires 86 may disconnect due to the difference in thermal expansions between the top plate 41 and the partitioning resin layer 82. However, this problem doses not arise when the partitioning resin layer 82 is not used.

Figure 11A:
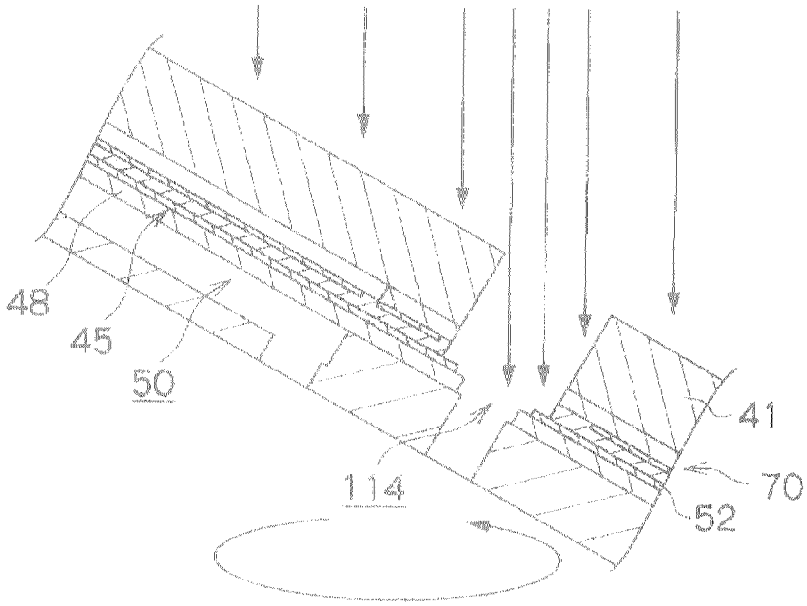
FIG. 11A through FIG. 11C are cross-sectional views showing processes of manufacturing the connecting wires and the like of the inkjet recording head relating to the third exemplary embodiment.
Figure 11B:
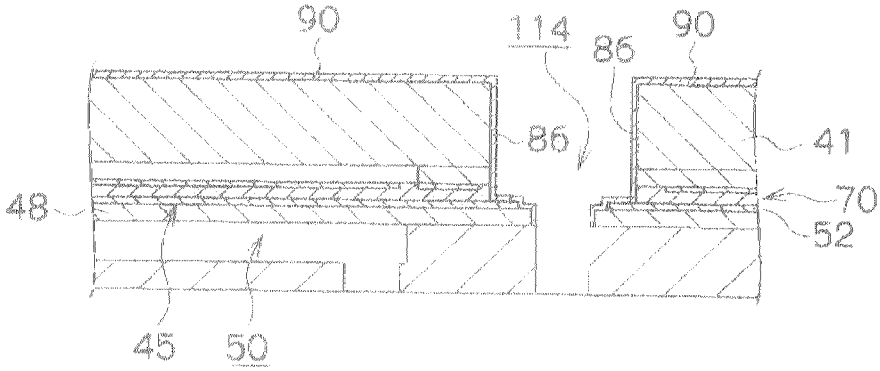
Figure 11C:
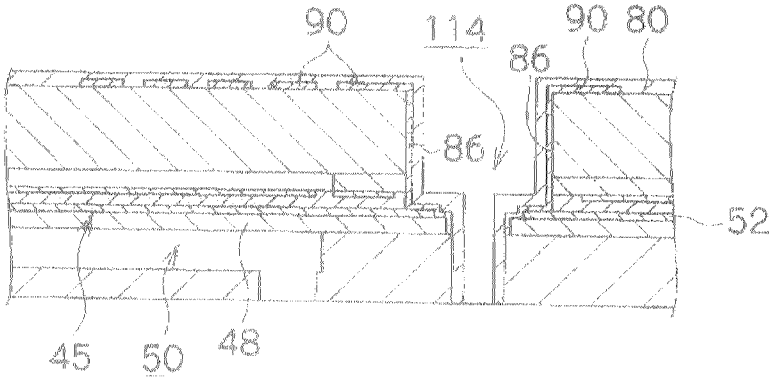

FIG. 11A through FIG. 11C are drawings showing an example of a method of manufacturing the connecting wires 86 which are shown in the present exemplary embodiments. FIG. 11A is a method in which, after the top plate 41 is formed on the piezoelectric element substrate 70, the work (not shown) which holds the piezoelectric element substrate 70 is tilted by a predetermined angle (to the extent that the shadow of the ink supply path 114 does not extend to the portion where the lower electrode 52 is exposed), and the connecting wires 86 and the metal wires 90 are formed by sputtering while rotating the work.

In this way, as shown in FIG. 11B, the connecting wires 86 are reliably connected to the lower electrodes 52 and the metal wires 90. Then, as shown in FIG. 11C, the metal wires 90 which are formed by sputtering are patterned, and thereafter, the surfaces of the connecting wires 86 and the metal wires 90 are covered by the low water permeable insulating film (SiOx film) in a vapor deposition step.

These inkjet recording heads 32 are structured such that the vibrating plates 48 (the piezoelectric elements 45) are disposed between the ink pooling chamber 38 and the pressure chambers 50, and the ink pooling chamber 38 and the pressure chambers 50 do not exist on the same horizontal plane. Accordingly, the pressure chambers 50 are disposed adjacent to one another, and the nozzles 56 are disposed at a high density.

Further, the driving ICs 60 which apply voltage to the piezoelectric elements 45 are structured so as to not project-out further outwardly than the piezoelectric element substrate 70 (i.e., are incorporated within the inkjet recording head 32). Accordingly, as compared with a case in which the driving ICs 60 are mounted to the exterior of the inkjet recording head 32, the lengths of the metal wires 90 which connect the piezoelectric elements 45 and the driving ICs 60 can be shorter, and a lowering of the resistance from the driving ICs 60 to the piezoelectric elements 45 is thereby realized.

Namely, higher density of the nozzles 56, i.e., a high-density, matrix-like arrangement of the nozzles 56, is realized at a practical wiring resistance value, and higher resolution can thereby be realized. Moreover, because the driving ICs 60 are flip-chip mounted on the top plate 41, high-density wiring connection and a lowering of the resistance are easily realized, and further, a reduction in the heights of the driving ICs 60 is also devised (the driving ICs 60 can be made thinner). Accordingly, compactness of the inkjet recording head 32 also is realized.

In the inkjet recording device 10 of the above-described exemplary embodiments, ink droplets are selectively ejected, on the basis of the image data, from the inkjet recording units 30 of the respective colors of black, yellow, magenta, and cyan, such that a full-color image is recorded on the recording sheet P. However, the inkjet recording in the present invention is not limited to the recording of characters and images onto the recording sheet P.

Namely, the recording medium is not limited to paper, and the liquid which is ejected is not limited to ink. For example, the inkjet recording head 32 relating to the present invention can be applied to liquid droplet ejection devices in general which are used industrially, such as in fabricating color filters for displays by ejecting ink onto a high polymer film or glass, or in forming bumps for parts mounting by ejecting solder in a welded state onto substrate, or the like.

Further, in the inkjet recording device 10 of the above-described exemplary embodiments, the example of a so-called Full Width Array (FWA), which corresponds to the width of a sheet, is described. However, the present invention is not limited to the same, and a Partial Width Array (FWA) which has a main scanning mechanism and a sub scanning mechanism may be utilized.

An object of the present invention is to aim to make a liquid droplet ejection head, a liquid droplet ejection device, and an image forming apparatus more compact.

In order to achieve the above-described object, a first aspect of the present invention is a liquid droplet ejection head having: a vibrating plate at which is formed a piezoelectric element which deforms when voltage is applied; a wiring board disposed above the piezoelectric element, an electric wire for deforming the piezoelectric element being disposed at the wiring board; a liquid storage chamber provided at a side opposite to the piezoelectric element, with the wiring board sandwiched therebetween; a pressure chamber provided at a side opposite to the wiring board, with the vibrating plate sandwiched therebetween; an ejection opening that ejects liquid droplets from the pressure chamber; a liquid supply opening that supplies liquid within the liquid storage chamber to the pressure chamber; and a electrical connection portion that passes through the wiring broad and electrically connects the piezoelectric element and the electric wire through the liquid supply opening.

A second aspect has the feature that, in the liquid droplet ejection head of the first aspect, the electrical connection portion is formed at an inner wall of the liquid supply opening.

A third aspect has the feature that, in the liquid droplet ejection head of the first or second aspect, the electrical connection portion is formed by a vacuum deposition method.

A fourth aspect has the feature that, in the liquid droplet ejection head of any of the first through third aspects, the electric wire and the electrical connection portion are covered by a protective film.

A fifth aspect is a liquid droplet ejection device, wherein a plurality of the liquid droplet ejection head of any one of the first through fourth aspects are disposed along a width direction of a region at which liquid droplets can be ejected.

A sixth aspect is an image forming apparatus in which the liquid droplets are ink, and which has: a conveying portion that conveys a recording medium; and the liquid droplet ejection device of the fifth aspect which ejects liquid droplets onto the recording medium conveyed at the conveying portion, wherein the liquid droplets are ink.

A seventh aspect hast eh feature that, in the liquid droplet ejection head of the first aspect, a partitioning resin layer is layered above the piezoelectric element, the piezoelectric element comprises an upper electrode, a portion of which projects out from an inner edge portion of the partitioning resin layer at the liquid supply opening, and a lower electrode that is ground potential, one end side of the electrical connection portion is connected to the projecting-out portion of the upper electrode, and the other end side of the electrical connection portion is connected to the electric wire.

An eighth aspect has the feature that, in the liquid droplet ejection head of the first aspect, a projecting portion is formed convexly at a bottom surface side of the wiring board, at a position which corresponds to a peripheral wall of the pressure chamber, and the electrical connection portion is formed along surfaces of the wiring board.

In accordance with the first aspect, the region of the electric wire can be made to be small, and the liquid droplet ejection head can be made to be compact.

In accordance with the second aspect, the liquid supply opening can be used in common with the electrical connection portion, and the region which is occupied by the electrical connection portion can be made to be small.

In accordance with the third aspect, the electrical connection portion can be formed in the step of forming a piezoelectric element substrate at which the piezoelectric element is formed.

In accordance with the fourth aspect, corrosion of the electric wire and the electrical connection portion can be prevented.

In accordance with the fifth aspect, the liquid droplet ejection device can be made to be compact.

In accordance with the sixth aspect, the image forming apparatus can be made to be compact.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be define by the following claims and their equivalents.

What is claimed is:

1. A liquid droplet ejection head, comprising:

a vibrating plate at which is formed a piezoelectric element which deforms when voltage is applied;

a wiring board disposed above the piezoelectric element, an electric wire for deforming the piezoelectric element being disposed at the wiring board;

a liquid storage chamber provided at a side opposite to the piezoelectric element, with the wiring board sandwiched therebetween;

a pressure chamber provided at a side opposite to the wiring board, with the vibrating plate sandwiched therebetween;

an ejection opening that ejects liquid droplets from the pressure chamber;

a liquid supply opening that supplies liquid within the liquid storage chamber to the pressure chamber; and an electrical connection portion that passes through the wiring board and electrically connects the piezoelectric element and the electric wire through the liquid supply opening;

wherein a partitioning resin layer is layered above the piezoelectric element, the piezoelectric element comprises an upper electrode, a portion of which projects out from an inner edge portion of the partitioning resin layer at the liquid supply opening, and a lower electrode that is ground potential, one end side of the electrical connection portion is connected to the projecting-out portion of the upper electrode, and the other end side of the electrical connection portion is connected to the electric wire.

2. The liquid droplet ejection head of claim 1, wherein the electrical connection portion is formed at an inner wall of the liquid supply opening.

3. The liquid droplet ejection head of claim 2, wherein the electrical connection portion is formed by a vacuum deposition method.

4. The liquid droplet ejection head of claim 1, wherein the electrical connection portion is formed by a vacuum deposition method.

5. The liquid droplet ejection head of claim 1, wherein the electric wire and the electrical connection portion are covered by a protective film.

6. The liquid droplet ejection head of claim 1, wherein a projecting portion is formed convexly at a bottom surface side of the wiring board, at a position which corresponds to a peripheral wall of the pressure chamber, and the electrical connection portion is formed along surfaces of the wiring board.

7. A liquid droplet ejection device, wherein a plurality of liquid droplet ejection heads are disposed along a width direction of a region at which liquid droplets can be ejected, each of the liquid droplet ejection heads comprising:

a vibrating plate at which is formed a piezoelectric element which deforms when voltage is applied;

a wiring board disposed above the piezoelectric element, an electric wire for deforming the piezoelectric element being disposed at the wiring board;

a liquid storage chamber provided at a side opposite to the piezoelectric element, with the wiring board sandwiched therebetween;

a pressure chamber provided at a side opposite to the wiring board, with the vibrating plate sandwiched therebetween;

an ejection opening that ejects liquid droplets from the pressure chamber;

a liquid supply opening that supplies liquid within the liquid storage chamber to the pressure chamber, and an electrical connection portion that passes through the wiring board and electrically connects the piezoelectric element and the electric wire through the liquid supply opening;

wherein a partitioning resin layer is layered above the piezoelectric element, the piezoelectric element comprises an upper electrode, a portion of which projects out from an inner edge portion of the partitioning resin layer at the liquid supply opening, and a lower electrode that is ground potential, one end side of the electrical connection portion is connected to the projecting-out portion of the upper electrode, and the other end side of the electrical connection portion is connected to the electric wire.

8. The liquid droplet ejection device of claim 7, wherein the electrical connection portion is formed by a vacuum deposition method.

9. The liquid droplet ejection device of claim 7, wherein the electric wire and the electrical connection portion are covered by a protective film.

10. The liquid droplet ejection device of claim 7, wherein the electrical connection portion is formed at an inner wall of the liquid supply opening.

11. An image forming apparatus, comprising:

a conveying portion that conveys a recording medium; and a liquid droplet ejection device which ejects liquid droplets onto the recording medium conveyed at the conveying portion, wherein the liquid droplet ejection device is provided with a plurality of liquid droplet ejection heads along a width direction of a region at which liquid droplets can be ejected, each of the liquid droplet ejection heads, comprising:

a vibrating plate at which is formed a piezoelectric element which deforms when voltage is applied;

a wiring board disposed above the piezoelectric element, an electric wire for deforming the piezoelectric element being disposed at the wiring board;

a liquid storage chamber provided at a side opposite to the piezoelectric element, with the wiring board sandwiched therebetween;

a pressure chamber provided at a side opposite to the wiring board, with the vibrating plate sandwiched therebetween;

an ejection opening that ejects liquid droplets from the pressure chamber;

a liquid supply opening that supplies liquid within the liquid storage chamber to the pressure chamber; and an electrical connection portion that passes through the wiring board and electrically connects the piezoelectric element and the electric wire through the liquid supply opening;

wherein a partitioning resin layer is layered above the piezoelectric element, the piezoelectric element comprises an upper electrode, a portion of which projects out from an inner edge portion of the partitioning resin layer at the liquid supply opening, and a lower electrode that is ground potential, one end side of the electrical connection portion is connected to the projecting-out portion of the upper electrode, and the other end side of the electrical connection portion is connected to the electric wire, and the liquid droplets are ink.

* * * * *